US009233313B2

(12) United States Patent
Olivera et al.

(10) Patent No.: US 9,233,313 B2
(45) Date of Patent: Jan. 12, 2016

(54) AMBULATORY TOY

(75) Inventors: Raul Olivera, Greenville, TX (US); David Anthony Norman, Greenville, TX (US); Robert H. Mimlitch, III, Rowlett, TX (US); Jeffrey R. Waegelin, Rockwall, TX (US)

(73) Assignee: Innovation First, Inc., Greenville, TX (US)

( * ) Notice: Subject to any disclaimer, the term of this patent is extended or adjusted under 35 U.S.C. 154(b) by 119 days.

(21) Appl. No.: 13/594,998

(22) Filed: Aug. 27, 2012

(65) Prior Publication Data

US 2014/0057525 A1 Feb. 27, 2014

(51) Int. Cl.
*A63H 7/00* (2006.01)
*A63H 11/20* (2006.01)

(52) U.S. Cl.
CPC ..... *A63H 11/20* (2013.01)

(58) Field of Classification Search
CPC ..... A63H 7/00
USPC ..... 446/356
See application file for complete search history.

(56) References Cited

U.S. PATENT DOCUMENTS

| | | | | |
|---|---|---|---|---|
| 2,827,735 | A * | 3/1958 | Grimm, Jr. | 446/356 |
| 4,591,346 | A * | 5/1986 | Ikeda | 446/437 |
| 5,259,808 | A * | 11/1993 | Garr | 446/437 |
| 5,993,286 | A * | 11/1999 | Tacquard et al. | 446/351 |
| 6,238,264 | B1 * | 5/2001 | Kazami et al. | 446/356 |
| 6,292,567 | B1 * | 9/2001 | Marland | 380/208 |
| D458,320 | S * | 6/2002 | Domingues | D21/585 |
| 6,462,498 | B1 * | 10/2002 | Filo | 318/568.12 |
| 6,488,560 | B2 * | 12/2002 | Nishikawa | 446/356 |
| 6,648,720 | B1 * | 11/2003 | Domingues | 446/356 |
| 6,652,352 | B1 * | 11/2003 | MacArthur et al. | 446/356 |
| 6,652,353 | B1 * | 11/2003 | Lund et al. | 446/356 |
| 6,681,150 | B1 * | 1/2004 | Haga et al. | 700/245 |
| 6,705,917 | B2 * | 3/2004 | Filo | 446/379 |
| 6,752,683 | B1 * | 6/2004 | Godfrey | 446/356 |
| 6,769,954 | B2 * | 8/2004 | Su | 446/353 |
| 6,860,785 | B2 * | 3/2005 | Vap | 446/153 |
| 6,866,557 | B2 * | 3/2005 | Randall | 446/356 |
| 6,899,589 | B1 * | 5/2005 | Lund et al. | 446/351 |
| 7,115,014 | B2 * | 10/2006 | McGrath et al. | 446/356 |
| 7,356,951 | B2 * | 4/2008 | Spielberger et al. | 40/412 |
| 7,938,708 | B2 * | 5/2011 | Willet et al. | 446/330 |
| 8,038,503 | B2 * | 10/2011 | Norman et al. | 446/351 |
| 8,371,898 | B1 * | 2/2013 | Sinisi | 446/178 |
| 8,414,350 | B2 * | 4/2013 | Rehkemper et al. | 446/330 |
| 8,591,281 | B2 * | 11/2013 | Mimlitch et al. | 446/3 |
| D698,395 | S * | 1/2014 | Norman et al. | D21/650 |
| 8,834,226 | B2 * | 9/2014 | Norman et al. | 446/351 |
| 2011/0165821 | A1 * | 7/2011 | Randall | 446/356 |

* cited by examiner

*Primary Examiner* — Michael Dennis
*Assistant Examiner* — Dolores Collins
(74) *Attorney, Agent, or Firm* — Adam K. Sacharoff; Much Shelist

(57) ABSTRACT

An ambulatory toy includes a body; a drive mechanism coupled to the body; a plurality of leg members coupled to the drive mechanism, each of the leg members having a distal end disposed downwardly in a first position and adapted to contact a support surface; and a self-righting member coupled to at least one of the legs. The self-righting member adapted to move the distal ends of the legs of the toy from a second position to the first downwardly disposed position. The method of self-righting using the self-righting member coupled to the leg.

6 Claims, 5 Drawing Sheets

AMBULATORY TOY

TECHNICAL FIELD

This application discloses an ambulatory toy adapted for random movement of the toy and a mechanism for self-righting the toy.

BACKGROUND

Small ambulatory toys may be designed to move autonomously across a surface, e.g., a floor, table, or other relatively flat surface. In general, ambulatory toys include housing, a plurality of legs or wheels, and a drive mechanism. U.S. Pat. Nos. 6,866,557 and 8,038,503 provide information on drive mechanisms and power mechanisms for ambulatory toys.

SUMMARY

The present disclosure illustrates and describes an ambulatory toy capable of random movement and including several implementations of self-righting mechanisms adapted to return the toy to its upright operating position.

Various features can be incorporated into the ambulatory toy. For example, various implementations of the toy can include features (e.g., shape of the legs, number of legs, frictional characteristics of the leg tips, relative stiffness or flexibility of the legs, resiliency of the legs, and relative location of the drive mechanism for facilitating efficient transfer of power to legs or wheels for motion. The speed and direction of the ambulatory toy's movement can depend on many factors, including the power supply, the properties of the surface on which the ambulatory toy operates, the overall weight of the ambulatory toy, and so on.

Likewise, the ambulatory toy can be designed to encourage self-righting based on features that tend to encourage rolling when the ambulatory toy is on its back or side in combination with the relative flatness of the toy when it is upright (e.g., when the toy is "standing" on its leg tips or wheels). Features of the ambulatory toy can also be used to increase the appearance of random motion and to make the toy appear to respond intelligently to obstacles. Different leg or wheel configurations and placements can also induce different types of motion and/or different responses to obstacles or other forces. Moreover, adjustable leg lengths can be used to provide some degree of steering capability. In some implementations, the ambulatory toys can simulate real-life objects, such as crawling bugs, rodents, or other animals and insects.

Reaction to and Redirection from Obstructions

The ambulatory toy described herein can react to a wall or other obstruction and change directions without using any subsequent instruction or interventions by the operator or other secondary device. For example, the ambulatory toy described herein uses its legs to kick itself away to a new random orientation. In order to accomplish this movement, in one implementation the front legs are disposed forward to ensure that they will most often make contact with an obstruction before the nose could contact and stop forward progress. Additionally, the speed of movement of the legs impacts the ability that the toy can kick itself away from the obstruction sufficiently far that the chance of achieving a new orientation facing away from the obstruction is enhanced.

Random Propelling Motion on Walking Toys

In one implementation the ambulatory toy includes 6 moving legs; however, it can be adapted for use with fewer or more legs. The ambulatory toy includes several elements that contribute to the randomness of movement.

The main component is the use of a set of middle legs that are slightly longer than the others. Because the middle legs are longer, the toy tends to rock front to back as it moves along.

In some implementations all the legs translate to make contact with the support surface in a controlled sequence such that the toy will tend to rock back and forth at a frequency that is not in tune with its rocking natural frequency. Each time a front or rear leg makes contact and pushes, it imparts a slight angular force (moment) that changes the heading.

In other implementations the front and rear leg tips are positioned such that they push on a path that is not in the direction that the toy is facing, but rather on a slight angle so it is better able to kick against the wall.

Self-Righting Mechanism

There are many ambulatory toys which are propelled about such that they may tip or roll over during their operation. After tipping or rolling over, some prior art toys are no longer able to continue unless they are manually restored to their intended operating orientation. In many of these cases, having to restore the orientation is either inconvenient or annoying.

The present disclosure includes a discussion of several different ways to self-right ambulatory toys without manual intervention. Self-righting mechanisms for such ambulatory toys can be active or passive.

The self-righting mechanism can be either independent of, or integral to, the drive mechanism. The self-righting-mechanism can consist of any of the following:

Active mechanisms include:

Eccentric wheel or cam

Rotation lever

Oscillating crank with lever

Spring-loaded release lever

Integral Passive mechanisms include:

Upwardly disposed leg extension members

Humps/body protrusions

Low center of gravity

Integral passive self-righting mechanisms are active at all times when the toy is being operated. In one implementation of a passive self-righting mechanism, at least one of the legs includes an upwardly disposed extension member that is extended to a height that terminates at or above the uppermost point on the upper housing of the toy. This extension member can contact a surface and agitate (reciprocate) the toy randomly until it is self-righted ("flipped over"). In some implementations, the ambulatory toy has a wide leg structure which makes it difficult to flip over from side to side along a longitudinal axis from front to back. Therefore, the toy is designed to flip over from front to back about a transverse axis. In this implementation, an extension member is disposed on the back legs to agitate (reciprocate) the toy to flip to from the back forward to its nose. Upwardly disposed extension members on the middle legs complete the flipping motion over its nose. The shape of the extension members is configured to flip the toy back over in a random timeframe and to also look aesthetically pleasing.

For active self-righting mechanisms that include oscillating levers, it may be essential for the oscillation frequency to be tuned for the system. When required, it should be tuned to the natural frequency of the toy's rocking motion.

For toys with rocking motion the frequency would need to be tuned to some multiple of the natural frequency such that the activation always occurs at an optimal interval of the rocking motion. For example, if the rocking motion takes 1 second, the activation frequency would be every 0.2 seconds if the optimal rocking position range occurs for 0.2 seconds.

This also applies to rotating levers and any other continuously active self-righting mechanisms. In cases where the toy has no natural rocking motion, it may be necessary to have a springy material on the lever to induce oscillations at a frequency which produces ever-increasing oscillation amplitudes in the toy whose orientation is to be corrected.

In one implementation, the ambulatory toy includes a body; a drive mechanism coupled to the body; a plurality of leg members coupled to the drive mechanism, each of the leg members having a distal end disposed downwardly in a first position and adapted to contact a support surface; and a self-righting member coupled to at least one of the legs. The self-righting member is adapted to move the distal ends of the legs of the toy from a second position to the first downwardly disposed position. The disclosure further includes a method of self-righting using the self-righting member coupled to the leg.

In some implementations, the ambulatory toy includes a drive mechanism coupled to the plurality of legs via one or more intermediate gears and sliders.

In some implementations, the self-righting member of the ambulatory toy comprises an upwardly disposed extension member disposed on at least one of the plurality of legs, wherein the extension member extends upwardly and terminates at a point in or above a plane passing through the uppermost point of the body, said plane being generally parallel to the support surface on which the ambulatory toy is ambulatory. In some implementations, the extension member is integral with the leg member and adapted to move with the leg member. In some implementations, the extension member includes a distal tip adapted to contact the support surface and displace the ambulatory toy away from the contacted surface. In some implementations, the ambulatory toy may include six legs disposed longitudinally along the toy body in a front, middle, and a rear set of opposing pairs.

The ambulatory toy includes numerous variations of the self-righting member. In some implementations, the self-righting member includes an upwardly disposed extension member disposed on each of the middle pair of legs, wherein the extension member extends upwardly and terminates at a point in or above a plane passing through the uppermost point of the body, said plane being generally parallel to the support surface on which the ambulatory toy is ambulatory. In other implementations, the self-righting member includes an upwardly disposed extension member disposed on at least one of the rear legs, said extension member disposed on the rear leg extending upwardly a lesser distance than the upwardly disposed extension members of the middle pair of legs. In yet other implementations, the self-righting member includes an upwardly disposed extension member disposed on each of the rear legs, wherein the extension member disposed on one of the rear legs extending upwardly a lesser distance than the upwardly disposed extension member on the other rear leg. In other implementations, the self-righting member further includes an upwardly disposed extension member disposed on at least one of the front legs, said extension member disposed on the front leg extends upwardly a lesser distance than at least one of the upwardly disposed extension members on the rear leg.

The toy may be operated by activating a drive mechanism disposed in a body of the toy. The drive mechanism is operatively coupled to each of the plurality of leg members and after activation of the drive mechanism the plurality of legs move in a predetermined motion. The toy is positioned in an upright operating first position with the downwardly disposed distal end of at least one leg contacting the support surface and said leg moving in said predetermined motion. The toy can then be positioned in an upturned second position with said plurality of legs moving in said predetermined motion and wherein no distal ends of the plurality of legs contact the support surface. The method of operation includes contacting the support surface with at least a first upwardly disposed extension member disposed on a first leg of the plurality of legs moving in the predetermined motion, wherein said first extension member contacts the support surface and displaces the toy body away from the support surface; contacting the support surface with at least a second upwardly disposed extension member disposed on a second leg of the plurality of legs moving in the predetermined motion, while the toy is displaced from the support surface by the first extension member, said second extension member contacting the support surface and displacing the toy body an additional distance from the support surface; contacting the support surface with at least a third upwardly disposed extension member disposed on a third leg of the plurality of legs moving in the predetermined motion while the toy body is displaced from the support surface by the first and second extension members, said third extension member contacting the support surface and displacing the toy body a sufficient distance from the support surface that the toy self-rights itself with at least one downwardly disposed distal end of at least one of the plurality of legs contacting the support surface and moving in said predetermined motion.

For alternate embodiments of the toy that include six legs disposed longitudinally along the toy body in a front, middle, and a rear set of opposing pairs and wherein the two middle legs have longer extension members than extension members of the rear and front legs, and at least one of the extension members on the rear legs is longer than the extension members of the front legs, the method of operation includes: contacting the support surface with the two middle leg extensions; contacting the support surface with at least one of the rear leg extensions; and pivoting the toy forward over the middle leg extensions.

In some embodiments the toy includes an active self-righting mechanism. In some implementations the ambulatory toy includes: a body; a drive mechanism coupled to the body; a plurality of leg members coupled to the drive mechanism, each of the leg members having a distal end disposed downwardly in a first position, said distal end adapted to contact a support surface on which the ambulatory toy is ambulatory; and a self-righting mechanism coupled to the drive member. The self-righting member is adapted to move a push pin into contact with the support surface and displace the toy away from the support surface.

In other implementations, the active self-righting mechanism comprises: a rotatable member mounted on a rotatable shaft coupled to the drive mechanism; an arm movably coupled to the rotating member by a crank pin; and the push pin is movably connected by a wrist pin at a distal end of the arm. In a similar implementation the self-righting mechanism includes: a rotating member mounted on a shaft coupled to the drive mechanism; and the push pin member coupled by a crank pin to the rotating member, said push pin member adapted to reciprocate and translate from side to side and adapted to move the push pin into contact with the support surface and displace the toy away from the support surface.

In other embodiments, the ambulatory toy includes: a body; a drive mechanism coupled to the body; a plurality of leg members coupled to the drive mechanism, each of the leg members having a distal end disposed downwardly in a first position, said distal end adapted to contact a support surface on which the ambulatory toy is ambulatory; and an active self-righting mechanism coupled to the drive member. The active self-righting member includes: a rotating lever mounted at a proximal end on a rotatable shaft, said rotatable shaft coupled at a distal end to a rotating member coupled to the drive mechanism, said rotating lever adapted to contact the support surface and displace the toy away from the support surface.

In other embodiments the ambulatory toy includes a body; a drive mechanism coupled to the body; a plurality of leg members coupled to the drive mechanism, each of the leg members having a distal end disposed downwardly in a first position, said distal end adapted to contact a support surface on which the ambulatory toy is ambulatory; and an active self-righting mechanism coupled to the drive member. The active self-righting member includes: a pivotable lever member including a cam follower member that is adapted to contact the outer surface of a rotatable cam member, said cam member coupled to the drive mechanism, said cam member having a discontinuity on the outer cam surface, said discontinuity adapted to release the spring loaded pivotable lever member; said pivotable lever member adapted to contact the support surface and displace the toy away from the support surface.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
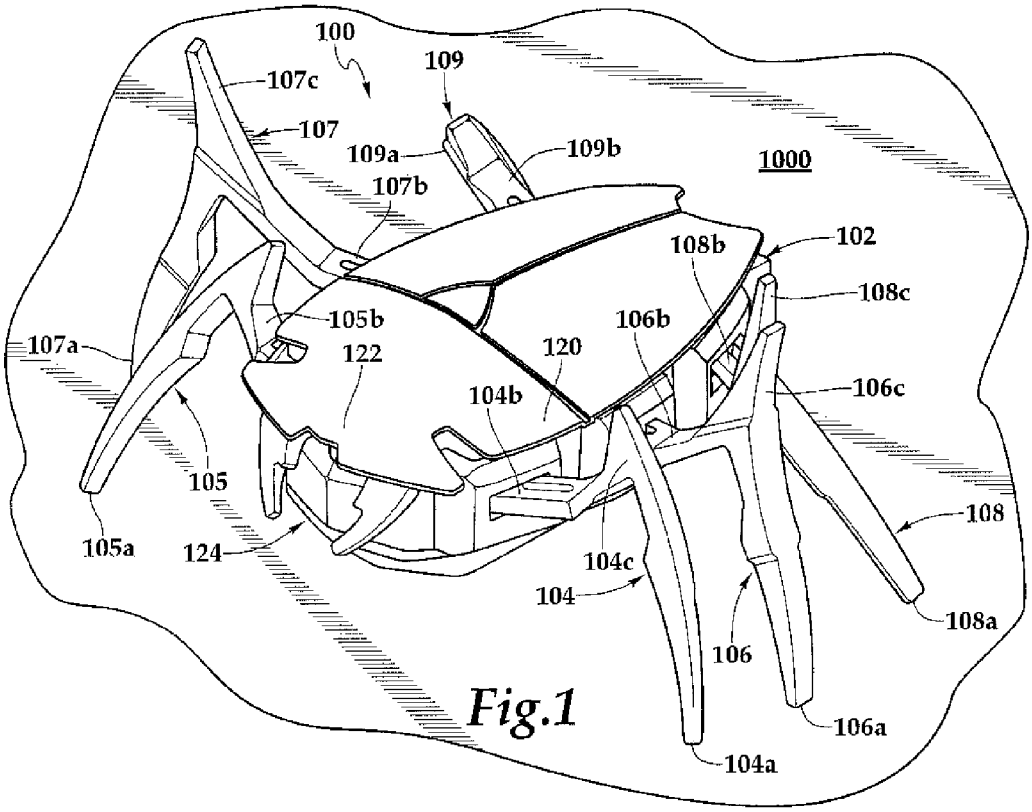
FIG. 1 is a perspective of a first implementation of an ambulatory toy of the present disclosure in an upright first position.
Figure 7A:
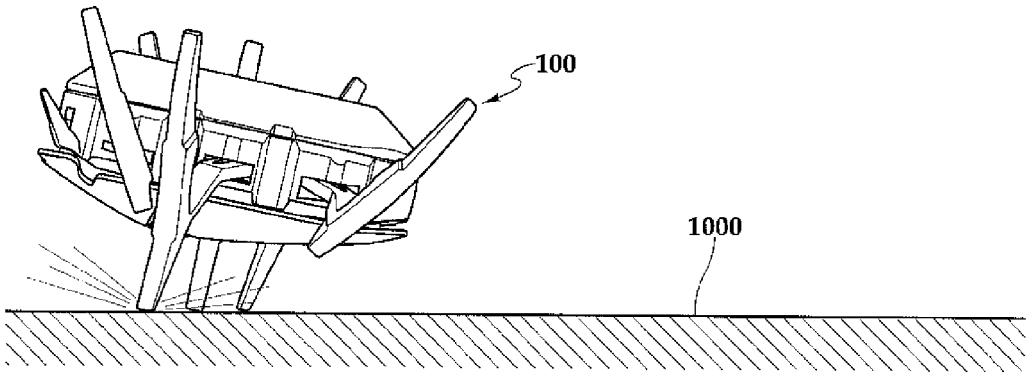
FIG. 7A is a left side view illustrating the toy of FIG. 1 in an overturned second position.
Figure 7B:
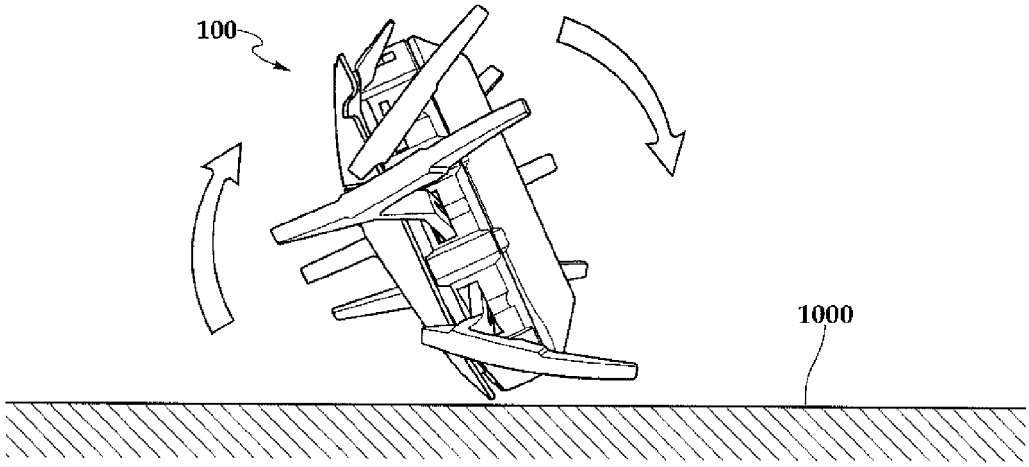
FIG. 7B is a left side view illustrating the toy of FIG. 1 in an intermediate position between the overturned position of FIG. 7 and the upright position of FIG. 1.
Figure 7C:
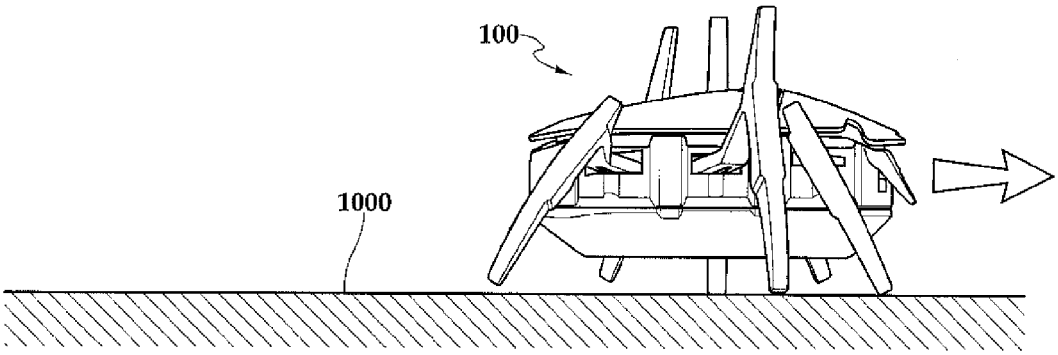
FIG. 7C is a left side view illustrating the toy of FIG. 1 in an upright position of FIG. 1.

FIG. 1 is a perspective view that illustrates a first implementation of an ambulatory toy 100. Additional views of the toy 100 of FIG. 1 are illustrated in FIGS. 2-6. The toy 100 is shaped like a scarab bug. The toy 100 includes a housing 102 (e.g., resembling the body of the scarab bug) and a plurality of movable legs 104, 105, 106, 107, 108 and 109. Each of the legs 104, 105, 106, 107, 108 and 109 includes a leg tip 104*a*, 105*a*, 106*a*, 107*a*, 108*a* and 109*a* and a leg base 104*b*, 105*b*, 106*b*, 107*b*, 108*b* and 109*b*. The properties of the legs 104, 105, 106, 107, 108 and 109, including the position of the leg base 104*b*, 105*b*, 106*b*, 107*b*, 108*b* and 109*b* relative to the leg tip 104*a*, 105*a*, 106*a*, 107*a*, 108*a* and 109*a*, can contribute to the direction and speed in which the toy 100 tends to move. The toy 100 is depicted in FIGS. 1-6 in a first upright position (i.e., standing on legs) on a supporting surface 1000 (e.g., a substantially planar floor, table top, etc. that counteracts gravitational forces). The toy 100 is depicted in FIG. 7A upside down (in a second position). The toy 100 in FIG. 7B is depicted in an intermediate position between position 2 and position 1. FIG. 7C illustrates the toy in a self-righted upright position of FIG. 1. It will be understood that the ambulatory toy 100 is not limited to a body configured as a scarab. Other bugs, insects and animal configurations come within the scope of this disclosure.

Figure 8:
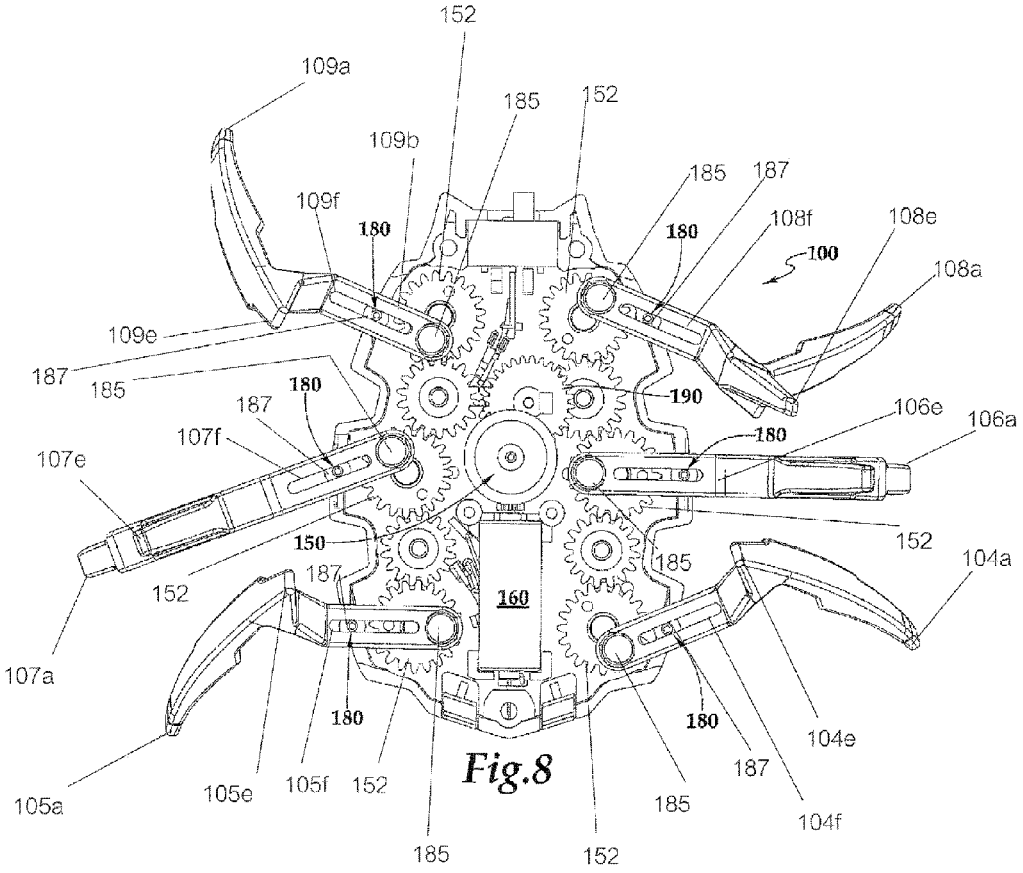
FIG. 8 is a top view of the toy of FIG. 1 with the upper portion of the housing removed to allow illustration of one implementation of a drive mechanism for the toy of FIG. 1.

Referring to FIG. 8 wherein is illustrated a top view of the toy 100 with the upper portion of the housing removed. The drive mechanism 150 includes a rotatable motor 160 and intermediate gears 190 and slider mechanisms 180 positioned between the drive mechanism 150 and the movable legs 104, 105, 106, 107, 108 and 109. Each movable leg includes a leg base (104*b*, 105*b*, 106*b*, 107*b*, 108*b* and 109*b*) extending laterally between the distal end (or leg tip 104*a*, 105*a*, 106*a*, 107*a*, 108*a* and 109*a*) and the terminal end (104*e*, 105*e*, 106*e*, 107*e*, 108*e* and 109*e*). Each leg base is secured by a leg pin 185 to a gear 152. The gears 152 are rotatably driven as the motor 160 drives the drive mechanism 150. The slider mechanism 180 is positioned on each of the moveable legs and includes a slot (104*f*, 105*f*, 106*f*, 107*f*, 108*f* and 109*f*) engaged with a housing pin 187 that is fixed to the housing. The gears and slider mechanisms translate the rotational output of the motor into lateral movement of each leg and thereby provide movement for the toy 100. As such when the drive mechanism is activated, each gear rotates cause the distal ends and the terminal ends of the leg members to rotate. U.S. Pat. Nos. 6,866,557 and 8,038,503 provide additional information on exemplary toy drive mechanisms. Lastly, the gears 152 that are secured to each movable leg are substantially perpendicular to the axis of rotation defined by the motor 160, such that the rotation of the distal ends and the terminal ends of the leg members is substantially perpendicular to the axis of rotation.

Overview of Legs

Legs 104 can include pairs of front legs 104 and 105, middle legs 106 and 107 and rear legs 108 and 109. For example, the toy 100 can include a pair of middle legs that may be designed to perform differently from front and rear legs.

In alternative implementations, there may be more or less than 6 legs. In some implementations, front legs 104, 105 and one or more rear legs 108 and 109 can be designed to be in contact with a support surface, while middle legs 106, 107 can be slightly off the surface so that the middle legs do not introduce significant additional drag forces and/or hopping forces that may make it more difficult to achieve desired movements (e.g., tendency to move in a relatively straight line and/or a desired amount of randomness of motion).

Different leg lengths can be used to introduce different movement characteristics. As described here at a high level, many factors or features can contribute to the movement and control of the toy 100. The location and distribution of the legs 104, 105, 106, 107, 108 and 109 relative to the center of gravity ("CG") can also prevent tipping. For example, if pairs or rows of legs on each side of the toy 100 are too close together and the toy 100 has a relatively high CG (e.g., relative to the lateral distance between the rows or pairs of legs), then the toy 100 may have a tendency to tip over on its side. Thus, in some implementations, the toy includes rows or pairs of legs that provide a wider lateral stance (e.g., pairs of front legs, middle legs, and rear legs are spaced apart by a distance that defines an approximate width of the lateral stance) than a distance between the CG and a flat supporting surface 1000 on which the toy 100 rests in an upright position. Movement of the toy can also be influenced by the leg geometry of the legs 104, 105, 106, 107, 108 and 109.

Self-Righting

Self-righting, or the ability to return to an upright position (e.g., standing upright on leg tips 104*a*, 105*a*, 106*a*, 107*a*, 108*a* and 109*a*), is another feature of the toy 100. For example, the toy 100 can occasionally tip over or fall (e.g., falling off a table or a step) or intentionally be dropped or positioned upside down by the person playing with the toy. As a result, the toy 100 can end up on its top or its side. The ambulatory toy 100 of the present disclosure includes the ability to self-right itself; for example, if the toy 100 is activated and tips over or is placed on its side or back it will return to an upright position without intervention by the person playing with the toy.

Upwardly Disposed Extension Members on the Legs

In one implementation, at least one of the legs is extended to a height of at least the uppermost high point 140 of the housing 102 to allow the leg extension to contact a surface and agitate (reciprocate itself randomly until it is self-righted ("flipped over")). In some implementations the ambulatory toy has a wide leg structure which makes it difficult to flip over from side to side along a longitudinal axis from front to back. Therefore, in the present implementation, the toy is designed to flip over from back to front. Referring now to FIGS. 7A to 7C, in this implementation, an extension member 108*c* and 109*c* is disposed on each of the back legs 108 and 109 to agitate (reciprocate) the toy to flip from the back towards its nose. The two middle legs 106 and 107 have longer extension members 106*c* and 107*c* (relative to the extension members 108*c* and 109*c*). Therefore, as the toy is pushed forward by contact of the rear leg extensions 108*c* and 109*c* with the surface 1000, the toy pivots forward over the middle leg extensions that are contacting the surface 1000. At least one of the back leg extensions 108*c* is longer relative to the front leg extensions 104*c* and 105*c* so the back leg kicks the back up and then it flips over the middle legs toward the front. In some implementations, as illustrated herein, one of the back leg extensions 108*c* is longer than the other back leg extension 109*c*. This result is a slight rocking from side to side as the toy 100 is being self-righted. The self-righting process appears more random and is not a simple end over end summersault movement. The shape of the extension members (104*a*, 105*a*, 106*a*, 107*a*, 108*a* and 109*a*) are configured to flip the toy 100 back over in a random timeframe and to also look aesthetically pleasing. It will be understood that the relative lengths of the extension members 104*c*, 105*c*, 106*c*, 107*c*, 108*c* and 109*c* can be changed to adjust the self-righting motion from front to back or side to side or a combination thereof.

Configuration of the Housing

The configuration of the housing may be used for self-righting. For example, the housing 102 of the toy 100 may be configured to prevent the toy from resting on its top or side (e.g., using one or more protrusions 140 on the top and/or sides of the housing) to increase the tendency of the toy to bounce when on its top or side thereby enhancing the tendency to roll and self-right itself. To assist rolling from the top of the toy 100, a high point 140 or a protrusion can be included on the top of the toy 100. The high point 140 can prevent the toy from resting flat on its top. In some implementations, the high point 140 can be relatively stiff (e.g., a relatively hard plastic), while the top surface can be constructed of a more resilient material that encourages bouncing. Bouncing of the toy when the toy is on its back can facilitate self-righting by allowing the toy 100 to roll due to the forces caused by the motor as the head 122 bounces off the surface 100. The size or height of the high point 140 can be sufficiently large enough to prevent the toy 100 from simply lying flat on its back after tipping, yet sufficiently small enough to help facilitate the toy's roll and to force the toy 100 off its back after tipping. The shoulders 120 on the toy 100 can also decrease the tendency for the toy 100 to roll from its side onto its back, at least when the forces caused by the motor are in a direction that opposes rolling from the side to the back. Furthermore, use of a resilient material for the shoulder can increase bounce, which can also increase the tendency for self-righting (e.g., by allowing the toy 100 to bounce off the surface 1000 and allowing the counterweight forces to roll the toy while airborne).

Figure 2:
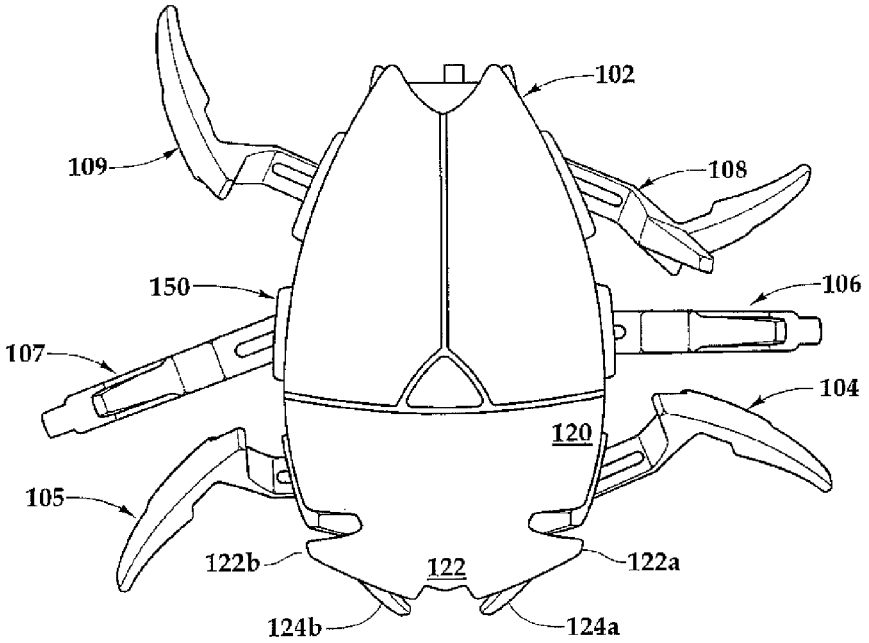
FIG. 2 is a top view of the toy of FIG. 1.
Figure 3:
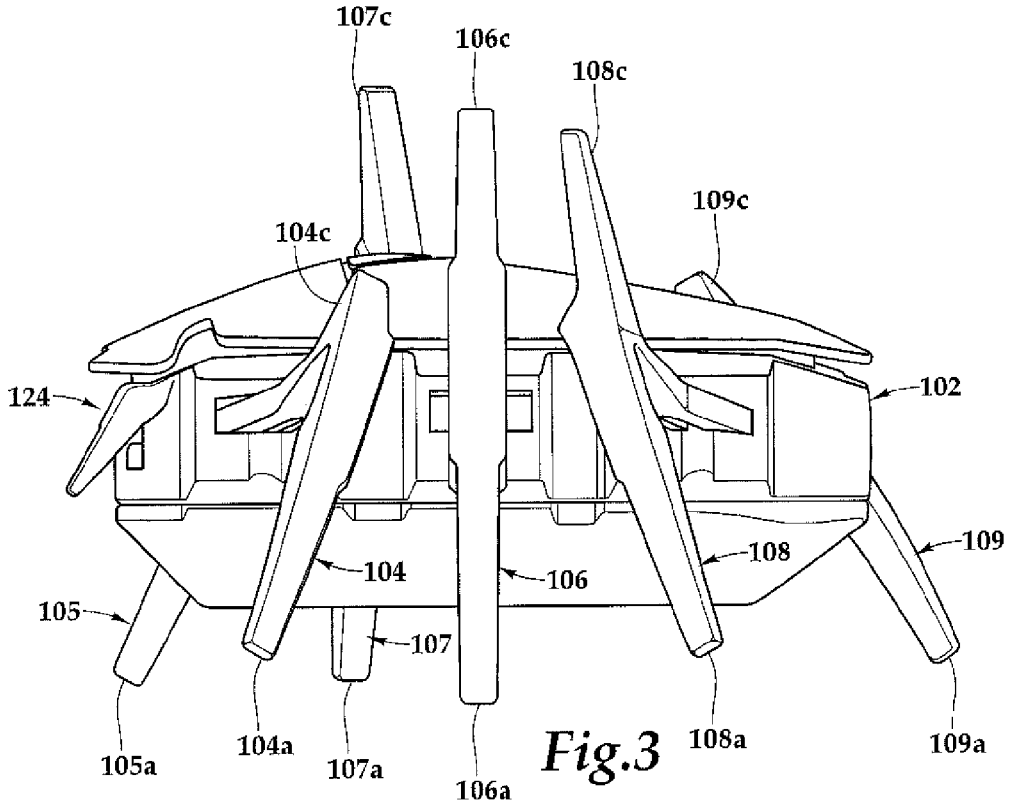
FIG. 3 is a right side view of the toy of FIG. 1.
Figure 4:
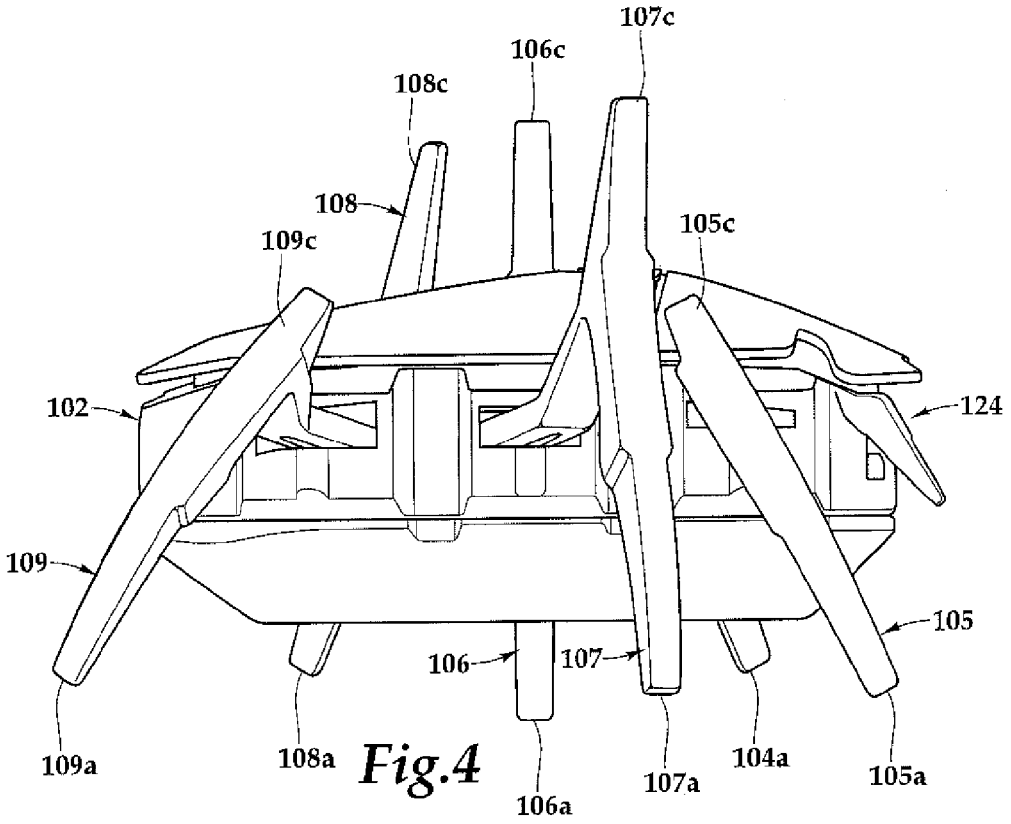
FIG. 4 is a left side view of the toy of FIG. 1.
Figure 5:
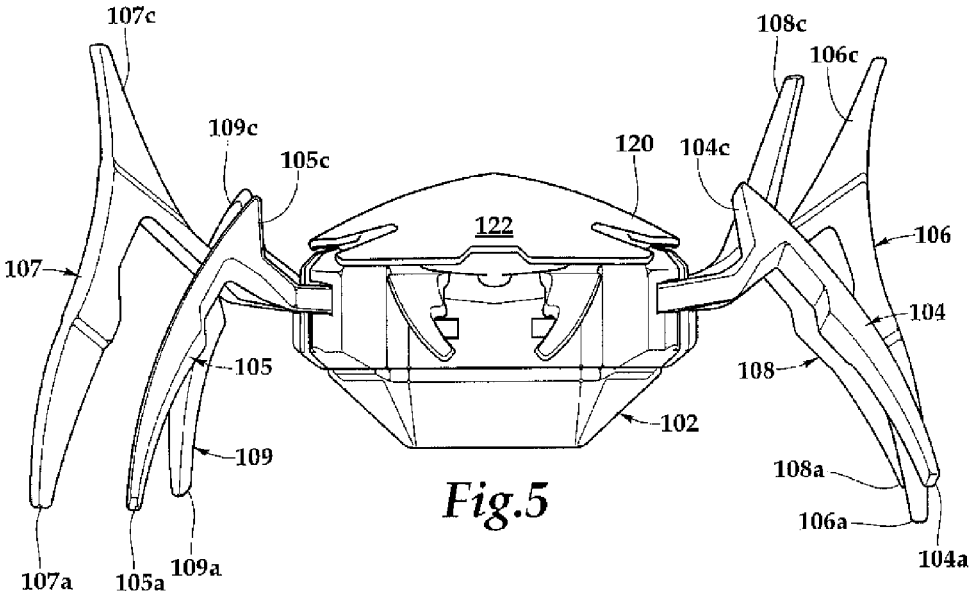
FIG. 5 is a front view of the toy of FIG. 1.
Figure 6:
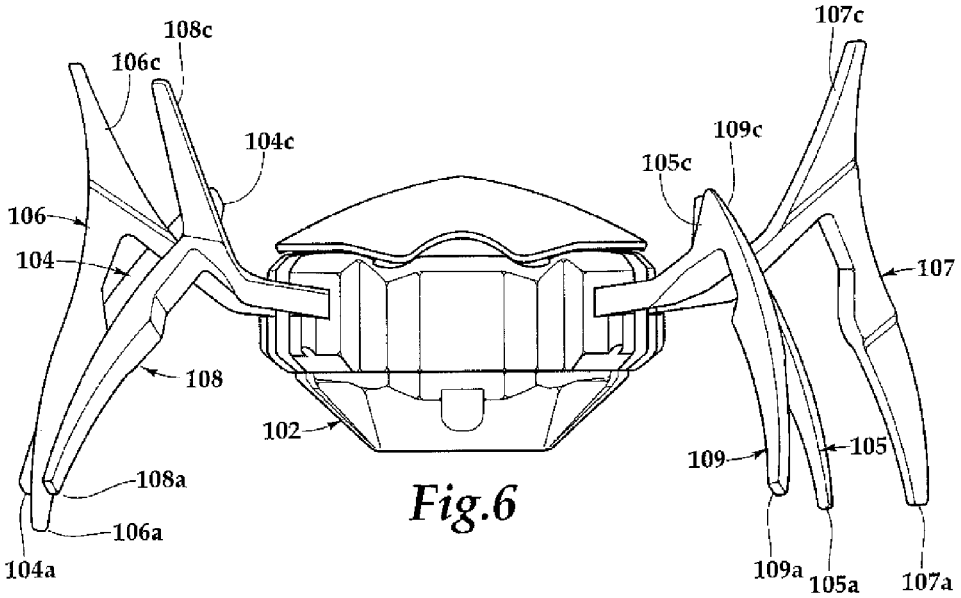
FIG. 6 is a rear view of the toy of FIG. 1.

As illustrated in FIGS. 1 and 2 configurations of a housing shoulder 120 and a head 122 and head side surfaces 122*a* and 122*b* can assist the toy 100 to self-right after tipping. FIG. 1 illustrates a nose 124 that can contribute to the ability of the toy 100 to deflect off of obstacles. The nose sides 124*a* and 124*b* have curved shapes to help to cause the toy 100 to deflect off obstacles (e.g., walls) encountered as the toy 100 moves in a generally forward direction.

Leg Shape

In some implementations, self-righting can be accomplished using the forces caused by the drive mechanism. Achieving this result can be helped by locating the toy's Center of Gravity ("CG") proximal to the motor's rotational axis to increase the tendency for the entire toy 100 to roll. This self-righting generally provides for rolling in the direction that is opposite to the rotation of the motor. Provided that a sufficient level of roll tendency is produced based on the rotational forces resulting from the rotation of the motor, the lateral spacing between the legs can be made wide enough to discourage rolling when the toy 100 is already in the upright position. Thus, the shape and position of the legs can be designed such that, when self-righting occurs and the toy 100 again reaches its upright position after tipping or falling, the toy 100 tends to remain upright. In particular, by maintaining a flat and relatively wide stance in the upright position, upright stability can be increased, and, by introducing features that reduce flatness when not in an upright position, the self-righting capability can be increased.

Center of Gravity

In some implementations, the toy 100 components are aligned to place the longitudinal CG close to (e.g., within 5-10% as a percentage of the height of the toy) the physical longitudinal centerline of the toy, which can reduce the rotational moment of inertia of the vehicle, thereby increasing or maximizing the forces on the vehicle as the rotational motor rotates the eccentric load. As discussed above, this effect increases the tendency of the toy 100 to roll, which can enhance the self-righting capability of the toy. Increasing the distance between pairs of legs help prevent the toy 100 from tipping. However, keeping the distance sufficiently low can improve the vehicle's ability to self-right after tipping. In general, to prevent tipping, the distance between pairs of legs needs to be increased proportionally as the CG is raised.

Active Self-Righting Mechanisms

Figure 9A:
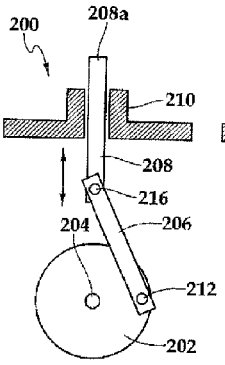
FIG. 9A is a schematic of a slider crank active self-righting mechanism.

Referring to FIG. 9A, therein is illustrated a self-righting mechanism 200 that produces linear motion. The mechanism 200 includes a rotating member 202 which is mounted on a shaft 204 driven by a drive mechanism 150 directly or through one or more intermediate gears. Movably coupled by a crank pin 212 to the rotating member 202 is an arm 206. A push pin member 208 is movably connected by a wrist pin 216 at a distal end of the arm 206. The push pin member 208 reciprocates in an opening in guide 210. The distal end 208*a* of the push pin member is adapted to contact the surface 1000 and push the toy 100 away from the surface 1000 assisting in self-righting the toy.

Figure 9B:
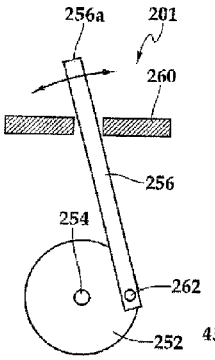
FIG. 9B is a schematic of another implementation of a slider crank active self-righting mechanism.

Referring to FIG. 9B, therein is illustrated a hybrid self-righting mechanism 201 that produces an agitating elliptic-like motion. The shape of the elliptical motion depends on the distance from the crank pin 262 to the surface 1000. The mechanism 201 includes a rotating member 252 which is mounted on a shaft 254 driven by a drive mechanism 150 directly or through one or more intermediate gears. Movably coupled by a crank pin 262 to the rotating member 202 is a push pin member 256 which reciprocates and translates from side to side through an opening in guide 260. The distal end 256*a* of the push pin member is adapted to contact the surface 1000 and push the toy 100 away from the surface 1000 assisting in self-righting the toy. In some implementations, the push pin members 208*a*, 256*a* of active self-righting mechanisms 200 and 201 of FIGS. 9A and 9B protrude from an upper portion of the housing 102 of the toy 100. These can be driven by the same drive mechanism 150 that drives the toy 100 or an independent drive system.

Figure 10:
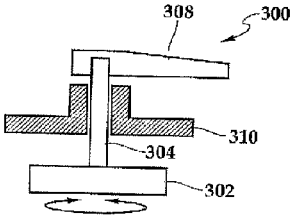
FIG. 10 is a schematic of a rotating lever active self-righting mechanism.

Referring to FIG. 10, therein is illustrated a self-righting mechanism 300 that includes a rotating lever 308 mounted at a proximal end of a rotatable shaft 304. The rotatable shaft is coupled at a distal end to a rotating member 302 that may be driven by the same drive system 150 that powers the toy or an independent drive system. The rotating shaft 304 may pass through an opening in a guide 310. The self-righting mechanism 300 can be used on the top or side of the housing 102 to change the orientation and assist in self-righting.

Figure 11:
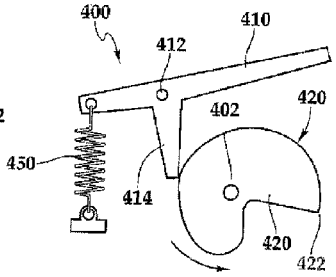
FIG. 11 is a schematic of a spring release lever active self-righting mechanism.

Referring to FIG. 11 therein is illustrated a self-righting mechanism 400 that includes a pivotable lever member 410 that pivots about a fixed point 412. The pivotable lever includes a projection that operates as a cam follower 414 by riding on an outer surface of a cam member 420. The cam member is rotated by the drive mechanism or a separate source of power. The pivotable lever member 410 is coupled to a spring 450 connected to the lever member 410. As the cam member 420 is rotated by a shaft 402, the pivotable lever member 410 is spring loaded until the cam follower reaches a discontinuity 422 on the cam outer surface. When the cam is rotated further, the follower of the spring loaded lever passes the discontinuity on the cam surface which functions as a release point wherein the spring loaded lever will pivot rapidly and can be used to assist in self-righting the toy 100. The self-righting member 400 can be used at the top of the housing 102 of the toy 100.

A number of embodiments of the invention have been described. Nevertheless, it will be understood that various modifications may be made without departing from the spirit and scope of the invention. Accordingly, other embodiments are within the scope of the following claims.

What is claimed is:

1. An ambulatory toy comprising:

a body having a top portion and a bottom portion;

a motor in communication with a drive mechanism coupled to the body;

a plurality of leg members coupled to the drive mechanism, each of the leg members having a distal end disposed downwardly below the bottom portion, wherein at least two of the plurality of leg members each include an extension member disposed upwardly, the extension members terminating at a terminal end in or above a plane passing through the uppermost point of the top portion of the body when one or more of the distal ends of the leg members are in contact with the support surface, and wherein at least one of the extension members is longer than the other extension member, and wherein each leg member, of the plurality of leg members, have a leg base extending laterally between the distal end and the terminal end and extending to couple to a gear, each gear being rotatably coupled to the drive mechanism such that the drive mechanism is configured to rotate the distal ends and the terminal ends of the leg members, and wherein each gear is positioned substantially perpendicular to an axis of rotation defined by the motor, such that the rotation of the distal ends and the terminal ends of the leg members is substantially perpendicular to the axis of rotation;

said ambulatory toy having a first position defined when one or more of said distal ends are in contact with a support surface and further having a second position defined when the top portion of the body is oriented below the bottom portion and at least one terminal end of the extension member in contact with said surface; and wherein when said drive mechanism rotates the plurality of legs members, the distal ends of the leg members are configured to cause the ambulatory toy to move laterally, across the surface when in the first position, and when in the second position, the terminal ends are configured to cause the ambulatory toy to rock from one end to another end such that the ambulatory toy flips from the second position to the first portion.

2. The ambulatory toy of claim 1, wherein each of the leg members include a slider mechanism defined as a slot positioned on each leg base and a pin that is fixed to the body and positioned through the slot.

3. The ambulatory toy of claim 1, wherein the extension member is integral with the leg member and configured to move with the leg member.

4. The ambulatory toy of claim 3, wherein the terminal end of the extension member is configured to contact the support surface and displace the ambulatory toy away from the contacted surface.

5. The ambulatory toy of claim 1 wherein the toy includes six legs disposed longitudinally along the toy body in a front, middle, and a rear set of opposing pairs.

6. An ambulatory toy comprising:

a body having a top portion and a bottom portion;

a motor configured to rotate a drive mechanism that is coupled to the body;

a plurality of leg members coupled to the drive mechanism, each of the leg members having a distal end disposed downwardly below the bottom portion, wherein at least two of the plurality of leg members each include an extension member disposed upwardly, the extension members terminating at a terminal end in or above a plane passing through the uppermost point of the top portion of the body when one or more of the distal ends of the leg members are in contact with the support surface, and wherein at least one of the extension members is longer than the other extension member, and wherein each leg member, of the plurality of leg members, further have a leg base extending between the distal end and the terminal end and extending to couple to a gear, each gear being rotatably coupled to the drive mechanism such that the drive mechanism rotates the distal ends and the terminal ends of the leg members, and wherein each gear is positioned substantially perpendicular to an axis of rotation defined by the motor, such that the rotation of the distal ends and the terminal ends of the leg members is substantially perpendicular to the axis of rotation, and wherein each of the leg members include a slider mechanism defined as a slot positioned on each leg base and a pin that is fixed to the body and positioned through the slot;

said ambulatory toy having a first position defined when one or more of said distal ends are in contact with a support surface and further having a second position defined when the top portion of the body is oriented below the bottom portion and at least one terminal end of the extension member in contact with said surface; and wherein when said drive mechanism rotates the plurality of legs members the distal ends of the leg members are configured to cause the ambulatory toy to move laterally across the surface on when in the first position, and when in the second position, the terminal ends are configured to cause the ambulatory toy to flip from the second position to the first portion.

* * * * *